United States Patent [19]

Pringle

[11] 4,181,173

[45] Jan. 1, 1980

[54] HEAT EXCHANGER ASSEMBLY

[75] Inventor: William L. Pringle, Grosse Pointe Shores, Mich.

[73] Assignee: United States Steel Corporation, Pittsburgh, Pa.

[21] Appl. No.: 880,991

[22] Filed: Feb. 24, 1978

[51] Int. Cl.[2] ..... F28F 3/12; F25B 39/02

[52] U.S. Cl. ..... 165/169; 62/523

[58] Field of Search ..... 62/523; 29/157.3 D; 113/118 D, 118 V; 165/169, 170, 168

[56] References Cited

U.S. PATENT DOCUMENTS

| | | | |
|---|---|---|---|
| 1,990,738 | 2/1935 | La Porte | 165/169 |
| 1,992,835 | 2/1935 | Newman | 113/118 D |
| 2,143,171 | 1/1939 | Anderson | 62/523 |
| 2,690,002 | 9/1954 | Grenell | 62/523 |
| 2,992,545 | 7/1961 | Walker | 62/523 |
| 3,134,242 | 5/1964 | Hanson | 62/523 |
| 3,712,372 | 1/1973 | Tranel | 165/170 |
| 3,965,887 | 6/1976 | Gramer et al. | 165/170 |
| 4,018,211 | 4/1977 | Barr | 126/271 |

*Primary Examiner*—Sheldon Jay Richter
*Attorney, Agent, or Firm*—McGlynn and Milton

[57] ABSTRACT

A heat exchanger assembly and method for making the assembly. The assembly includes a compartment having at least two sides to define at least one corner. A first plate member which defines the sides and the corner has at least one embossment on each side of the corner with one end of each embossment terminating in spaced relationship to the corner. A second plate member mating with the first plate member and connected by an epoxy adhesive compound defines fluid channel passages for receiving a heat exchange fluid. An embossment in the second plate member which extends about the outside of the corner and overlaps a portion of the ends of the first-mentioned embossments interconnects the first-mentioned embossments. Additionally, there is disclosed a method of making the heat exchanger assembly comprising the steps of; forming at least two horizontally spaced embossments in a first plate member and having one end of each of the embossments terminating to define a flat intermediate portion of the first plate member between each of the horizontally spaced embossments, forming at least one embossment in a second plate member, mating and fastening the plate members together to define fluid channel passages wherein each of the embossments in the second plate member extend over the flat intermediate portion of the first plate member and overlap a portion of each of the horizontally spaced embossments whereby the latter are interconnected, and bending the plate members at the flat intermediate portion to define a corner.

6 Claims, 4 Drawing Figures

HEAT EXCHANGER ASSEMBLY

BACKGROUND OF THE INVENTION (1) Field of the Invention

The subject invention relates to an improved heat exchanger wherein the heat-exchanging elements extend about one or more corners of a compartment. Although many applications are possible, the subject invention is illustrated and described herein as an improved evaporator system of a refrigeration assembly. In this connection, the improved construction for cooling coils or evaporator tubing as used in freezers, refrigerators, oil coolers for compressors and the like includes embossments in plate members which mate to form fluid channel passages for receiving a heat exchange fluid. The function of an evaporator system is to change the heat exchange fluid from the liquid phase to the vapor phase and absorb heat in the process.

(2) Description of the Prior Art

Typically, the prior art heat exchanger assemblies of the type forming an evaporator system include embossments in plate members which are mated together; however, the fluid channel passages of the prior art evaporator systems of this type are susceptible to some degree of collapse as they extend about various corners. If such a collapse occurs, there may be a significant drop in pressure of the heat exchange fluid in the fluid channel passages at areas of substantial deformation, such as at corners.

SUMMARY OF THE INVENTION

The subject invention relates to an improved heat exchanger assembly comprising a compartment having at least two sides to define at least one corner. A first plate member which defines the sides and the corner has at least one embossment on each side of the corner with one end of each embossment terminating in spaced relationship to the corner. A second plate member mates with the first plate member to define fluid channel passages for receiving a heat exchange fluid. An embossment in the second plate member extends about the outside of the corner and overlaps a portion of the ends of the first-mentioned embossments to interconnect the first-mentioned embossments. The plate members are attached together by connecting means.

Additionally, there is disclosed a method of making a heat exchanger assembly comprising the steps of; forming at least two horizontally spaced embossments in a first plate member and having one end of each of the embossments terminating to define a flat intermediate portion of the first plate member between each of the horizontally spaced embossments, forming at least one embossment in a second plate member, mating and fastening the plate members together to define fluid channel passages wherein each of the embossments in the second plate member extend over the flat intermediate portion of the first plate member and overlap a portion of each of the horizontally spaced embossments whereby the latter are interconnected, and bending the plate members at the flat intermediate portion to define a corner whereby one of the first-mentioned embossments are on each side of the corner and are interconnected by the second-mentioned embossments extending about the corner.

PRIOR ART STATEMENT

Typical of a heat exchanger assembly of the type to which the instant invention pertains is that shown in U.S. Pat. No. 2,992,545 granted to H. A. Walker on July 18, 1961. This patent discloses embossed plates which are joined together to form fluid channel passages which may be incorporated as part of an insulated refrigeration assembly. The evaporator system in this patent, however, is limited to a flat wall and does not suggest extending the evaporator system about the corners of a compartment.

Heat exchanger assemblies employing embossed plates fastened together to form fluid channel passages are also shown in U.S. Pat. No. 1,990,738 granted Feb. 12, 1935 to R. P. La Porte and 2,143,171 granted Jan. 10, 1939 to W. B. Anderson. The fluid channel passages disclosed in the La Porte '738 patent, however, extend in a helical pattern about a cylinder and are not subjected to the significant deformation and collapse which may occur when the fluid channel passages extend about a corner. The Anderson '171 patent discloses the fluid channel passages extending about the corners of a compartment but utilizes pre-formed components to provide an assembly which does not present the problem of deformation and collapse of the passages as a corner is formed in two united sheets.

U.S. Pat. No. 3,712,372 granted Jan. 23, 1973 to L. J. Tranel discloses tubular passageways which are flattened but are left undeformed or unflattened in areas where bends are to be made in order to prevent collapse of the tubing and the resulting pressure drop in the bend areas. The assembly disclosed in this patent, however, does not disclose embossments in a first plate member on each side of a corner which have one end of each embossment terminating in spaced relationship to the corner and being interconnected by an embossment in a second plate member extending about the outside surface of the corner.

Additionally, none of the patents discussed above disclose a method of making a heat exchanger as herein described.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
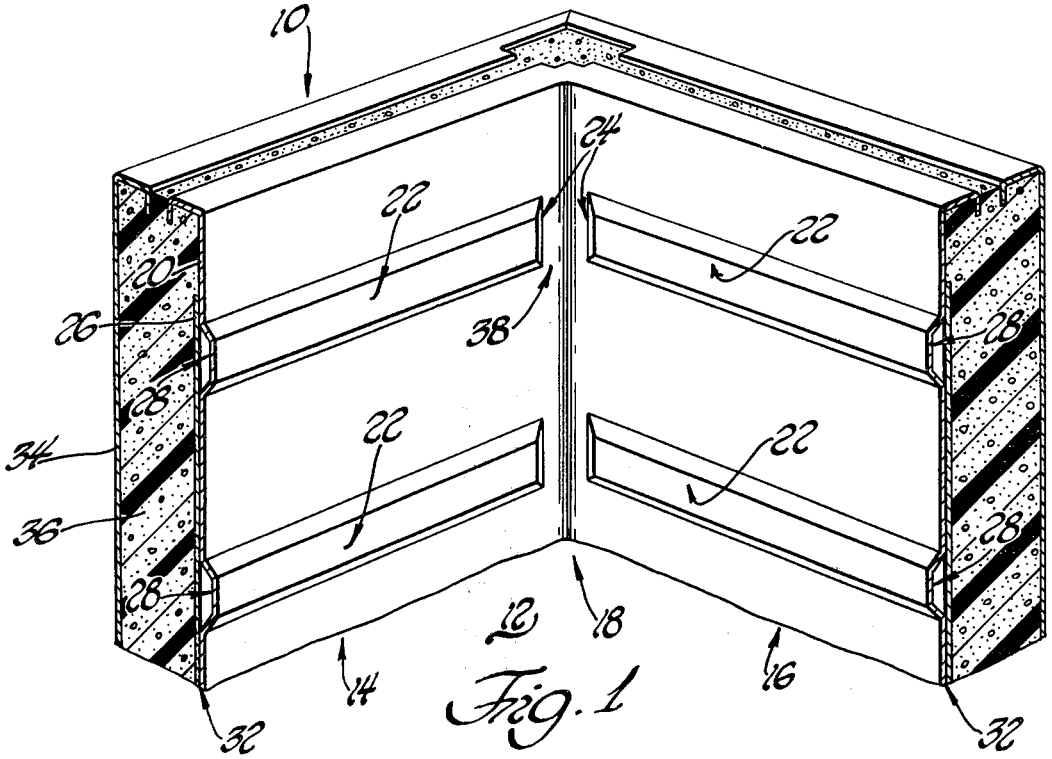
FIG. 1 is a fragmentary perspective view partially broken away and in cross section of a heat exchanger assembly constructed in accordance with the instant invention.
Figure 3:
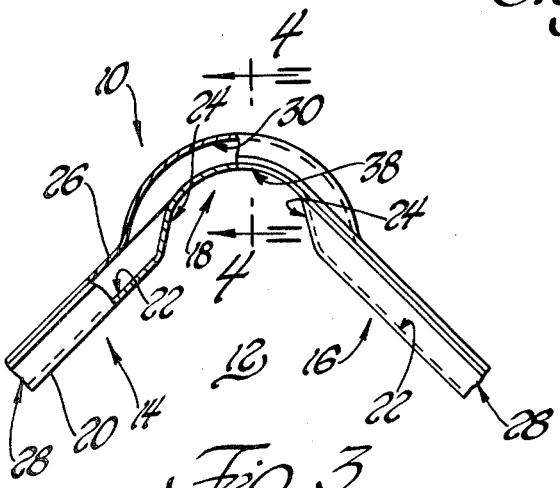
FIG. 3 is a fragmentary cross-sectional view similar to FIG. 2 but showing the first and second plate members after being formed about a corner.

A heat exchanger assembly constructed in accordance with the instant invention is generally shown at 10. Referring to FIGS. 1 and 3, the assembly 10 includes a compartment 12 having at least two sides generally shown at 14 and 16 to define at least one corner generally shown at 18.

Referring to the drawings in general, a first plate member 20 defines the sides 14 and 16 and the corner 18. There is at least one embossment 22 in the first plate member 20 on each of the sides 14 and 16 of the corner 18 and each embossment 22 has one end generally indicated at 24 which terminates in spaced relationship to the corner 18.

Figure 2:
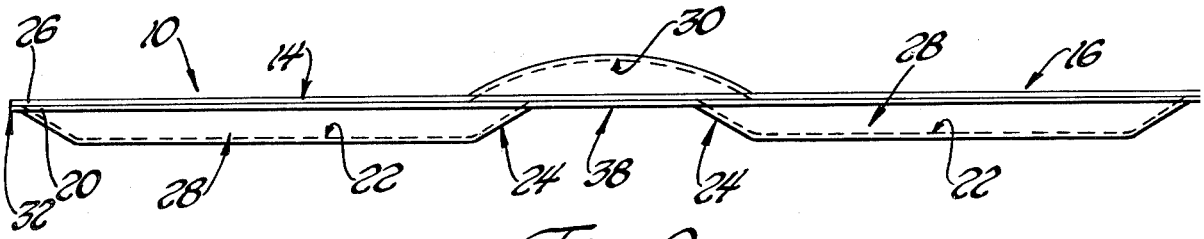
FIG. 2 is a fragmentary plan view illustrating details of the first and second plate members and their respective embossments before being formed about a corner.

A second plate member 26 mates with the first plate member 20 to define fluid channel passages generally indicated at 28 for receiving a heat exchange fluid. Referring to FIGS. 2 and 3, an embossment generally indicated at 30 in the second plate member 26 extends about the outside of the corner 18 and overlaps a portion of the ends 24 of the first-mentioned embossments 22 in order to interconnect these first-mentioned embossments 22. In other words, the first plate member 20 is bent to form two sides 14 and 16 and a corner 18; and embossment 22 on one side 14 is interconnected with a similar embossment 22 on the other side 16 by the embossment 30 in the second plate member 26 to define the continuous fluid channel passage 28. Additionally, it is noted that the embossments may be formed in the plate members by stamping.

The assembly 10 also includes connecting means for attaching the plate members 20 and 26 together. The connecting means includes an epoxy adhesive compound whereby the plate members 20 and 26 are held together by said compound which is generally indicated at 32. It is also possible, however, to attach the plate members 20 and 26 together by other fastening means, such as welding or the like.

Figure 4:
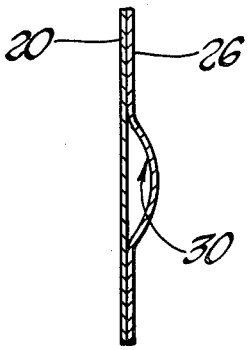
FIG. 4 is a cross-sectional view taken substantially along line 4—4 of FIG. 3.

Referring to FIGS. 2, 3 and 4, it will be appreciated that as the plate members 20 and 26 are bent from the configuration shown in FIG. 2 to the configuration shown in FIG. 3, the embossment 30 in the second plate member 26 limits or prevents any deformation or collapse of the fluid channel passages 28 which could cause a pressure drop of the heat exchange fluid. The embossment 30 in the second plate member 26 has a curved configuration. This curved configuration facilitates bending to form the corner 18 to thereby provide a continuous fluid channel passage 28 of a constant cross-sectional area.

Referring to FIG. 1, the fluid channel passages 28 include a plurality of such passages 28 being vertically spaced for providing an evaporator system of a refrigeration assembly and a plurality of the second-mentioned embossments 30 for interconnecting the first-mentioned embossments 22 about the corners 18. FIG. 1 illustrates a portion of such an evaporator system wherein the open ends of the fluid channel passages 28 shown in FIG. 1 would be interconnected and could be of a typical serpentine configuration.

Still referring to FIG. 1, the compartment 12 includes an outer wrapper 34 for providing the outer surface of the refrigeration assembly and insulation means 36 disposed between the outer wrapper 34 and the plate members 20 and 26 for insulating the refrigeration assembly. As mentioned above, FIG. 1 illustrates a portion of such a refrigeration assembly and, it is noted that a series of plate members 20 and 26 may be connected to each other to form all of the sides of the refrigeration assembly. Additionally, it is also possible to bend the plate members 20 and 26 in additional areas in order to form further sides and, thus, more corners.

Turning now to a method of making the heat exchanger assembly 10 as described above and referring to FIG. 2, the first step comprises forming at least two horizontally spaced embossments 22 in the first plate member 20 and having one end 24 of the embossments 22 terminating to define a flat intermediate portion generally indicated at 38 of the first plate member 20 between each of the horizontally spaced embossments 22 and 22. Still referring to FIG. 2, the next step is to form at least one embossment 30 in the second plate member 26. The plate members 20 and 26 are then mated and fastened together to define the fluid channel passages 28 wherein each of the embossments 30 in the second plate member 26 extend over the flat intermediate portion 38 of the first plate member 20 and overlap a portion 24 of each of the horizontally spaced embossments 22. Thus, the horizontally spaced embossments 22 are interconnected.

Referring to FIG. 3, the final step is bending the plate members 20 and 26 at the flat intermedite portion 38 in order to define the corner 18. As a result, one of the firstmentioned embossments 22 are on each side of the corner 18 and are interconnected by the second-mentioned embossments 30 extending about the outside of the corner 18. In other words, an embossment 22 on one side 14 of the corner 18 is interconnected with a similar embossment 22 on the other side 16 by the embossment 30 in the second plate member 26.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A heat exchanger assembly comprising; a compartment having at least two sides to define at least one corner, a first plate member for defining said sides and said corner, at least one embossment in said first plate member on each of said sides of said corner and having one end of each of said embosssments terminating in spaced relationship to said corner, said first plate member having a portion in each of said sides between said one end of said embossment therein and said corner which is coplanar with the remainder of said side of said first plate member surrounding said embossment therein, a second plate member mating with said first plate member to define fluid channel passages for receiving a heat exchange fluid, an embossment in said second plate member extending about the outside of said corner and overlapping a portion of said ends of said first-mentioned embossments to interconnect said first-mentioned embossments, and connecting means for attaching said plate members together.

2. An assembly as set forth in claim 1 wherein said fluid channel passages include a plurality of said passages being parallel and spaced for providing an evaporator system of a refrigeration assembly and a plurality of said second-mentioned embossments for interconnecting said first-mentioned embossments about said corners.

3. An assembly as set forth in claim 2 wherein said embossments in said second plate member have a curved configuration.

4. An assembly as set forth in claim 2 wherein said connecting means includes an epoxy adhesive compound.

5. An assembly as set forth in claim 4 wherein said compartment includes an outer wrapper for providing the outer surface of the refrigeration assembly.

6. An assembly as set forth in claim 5 wherein said compartment includes insulation means disposed between said outer wrapper and said plate members for insulating the refrigeration assembly.

* * * * *